US005325904A

United States Patent [19]

Leitner

[11] Patent Number: 5,325,904

[45] Date of Patent: Jul. 5, 1994

[54] PARTITIONING SYSTEM

[75] Inventor: Martin Leitner, Mozartstr. 3, D-7022 Leinfelden, Fed. Rep. of Germany

[73] Assignee: Martin Leitner, Fed. Rep. of Germany

[21] Appl. No.: 949,840

[22] PCT Filed: Jan. 10, 1992

[86] PCT No.: PCT/EP92/00038

§ 371 Date: Nov. 13, 1992

§ 102(e) Date: Nov. 13, 1992

[87] PCT Pub. No.: WO92/13149

PCT Pub. Date: Aug. 6, 1992

[30] Foreign Application Priority Data

Jan. 15, 1991 [DE] Fed. Rep. of Germany ..... 4100900

[51] Int. Cl.[5] ..... A47G 5/00

[52] U.S. Cl. ..... 160/135; 52/239; 403/230; 403/399; 403/DIG. 10

[58] Field of Search ..... 160/135, 229.1, 351; 52/239, 243; 403/230, 296, 399, DIG. 10

[56] References Cited

U.S. PATENT DOCUMENTS

| | | | |
|---|---|---|---|
| 3,987,836 | 10/1976 | LeMay | 160/135 |
| 4,109,429 | 8/1978 | Whisson | 52/239 X |
| 4,232,183 | 11/1980 | Person | 160/135 X |
| 4,299,067 | 11/1981 | Bertschi | 403/296 X |
| 5,219,406 | 6/1993 | Raz | 52/239 X |

FOREIGN PATENT DOCUMENTS

| | | |
|---|---|---|
| 0281081 | 9/1988 | European Pat. Off. . |
| 2552471 | 3/1985 | France . |

*Primary Examiner*—David M. Purol

*Attorney, Agent, or Firm*—Speckman, Pauley & Fejer

[57] ABSTRACT

A partitioning system with vertical posts and horizontal connecting tubes, where panels can be attached to the posts with connecting elements, the posts having a connecting bar which is perpendicular to the plane of the partition with a row of connecting bores, cantilevered arm elements, which extend perpendicular with respect to the partition plane, can be attached to the posts. A simple structure of partitions with a closed visible side is possible with the aid of specially designed connecting elements, without the connecting elements being visible.

39 Claims, 9 Drawing Sheets

FIG. 5
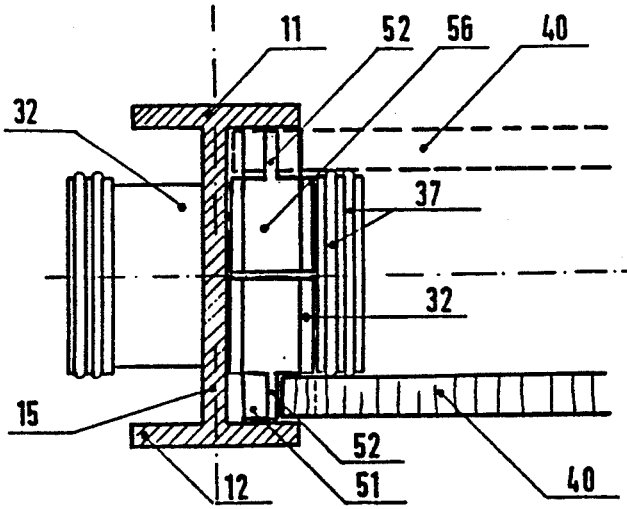
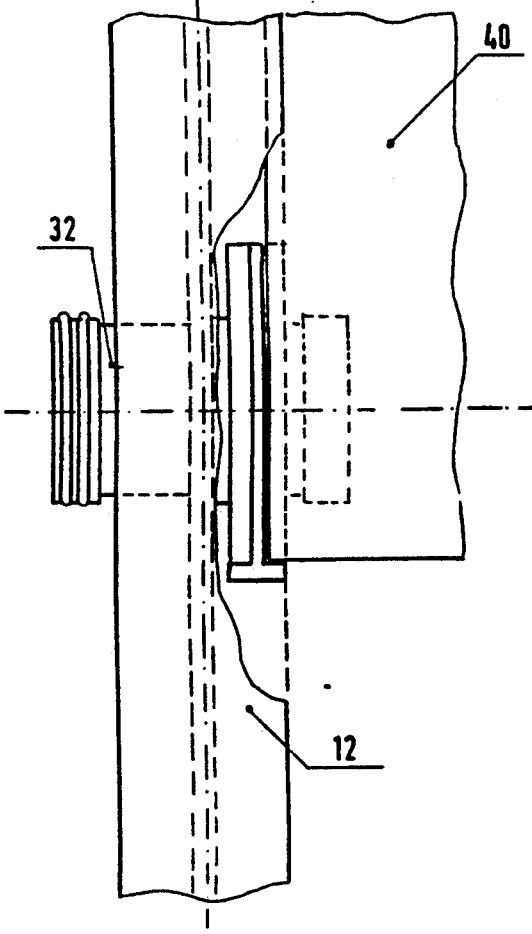
FIG. 6
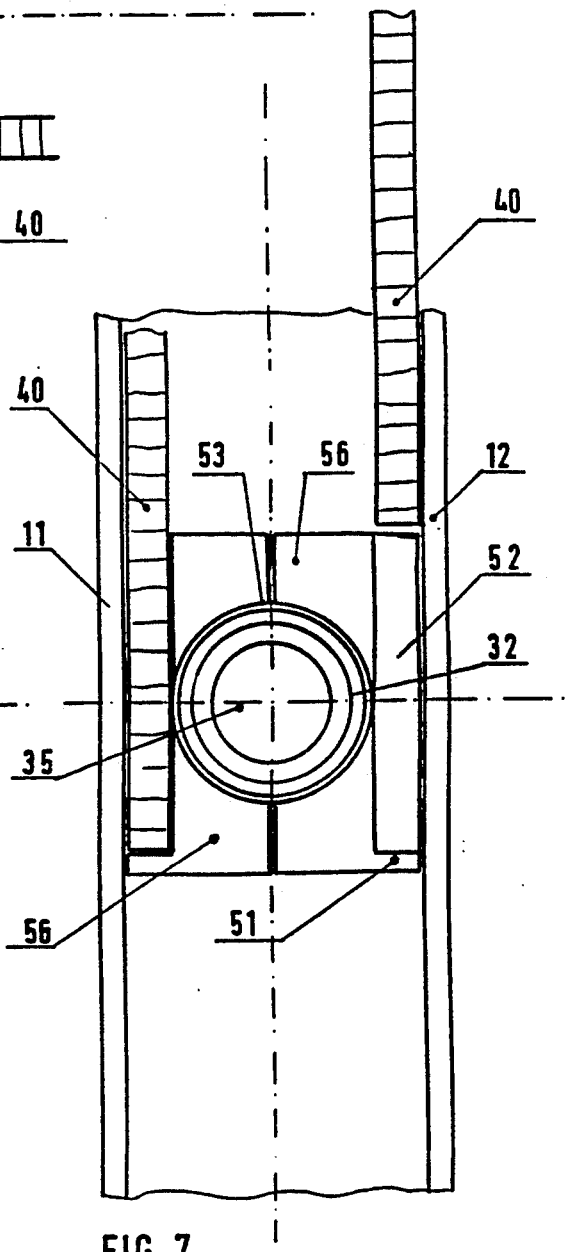
FIG. 7

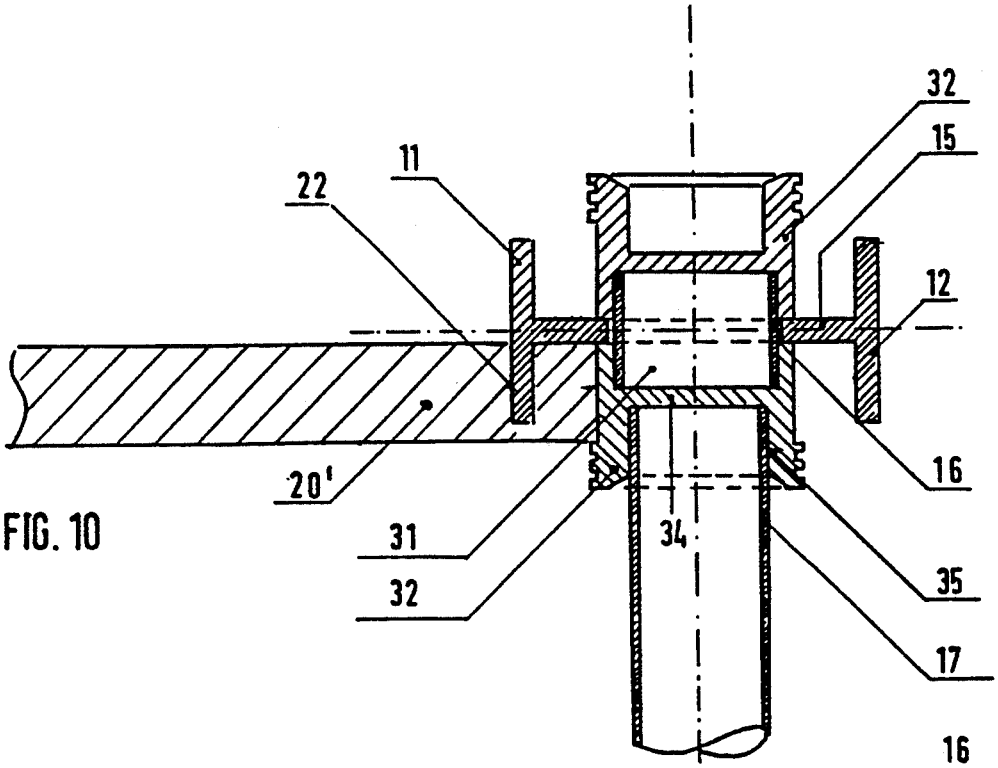
FIG. 10
FIG. 11
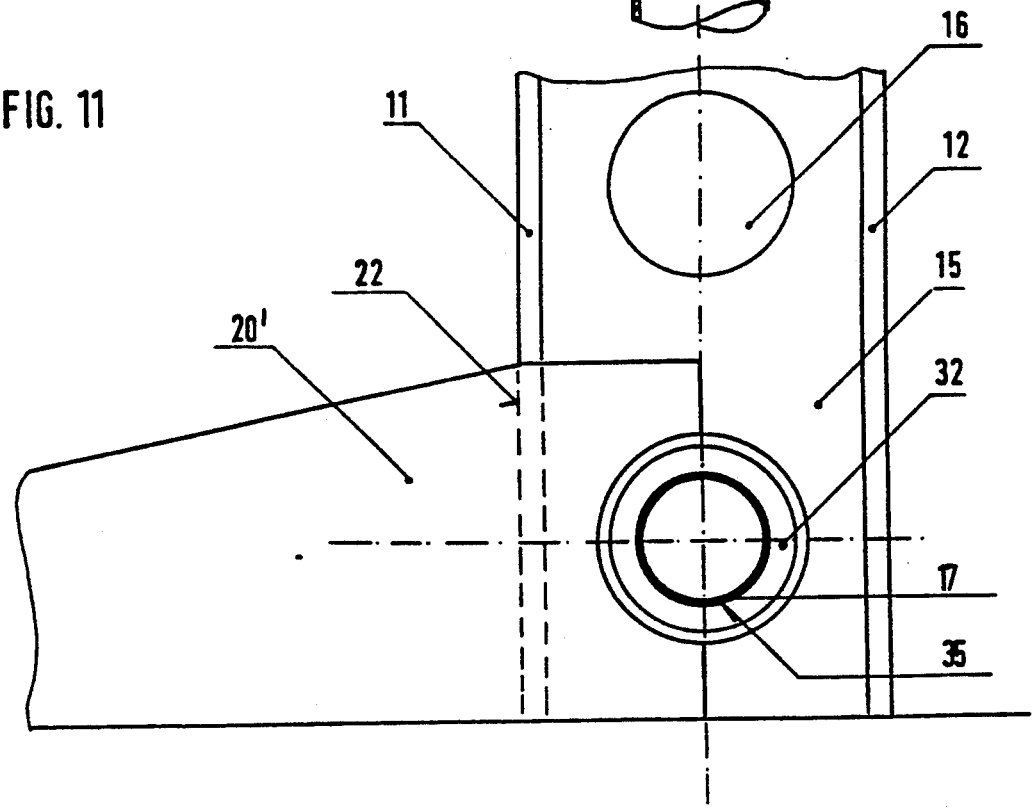

FIG. 12
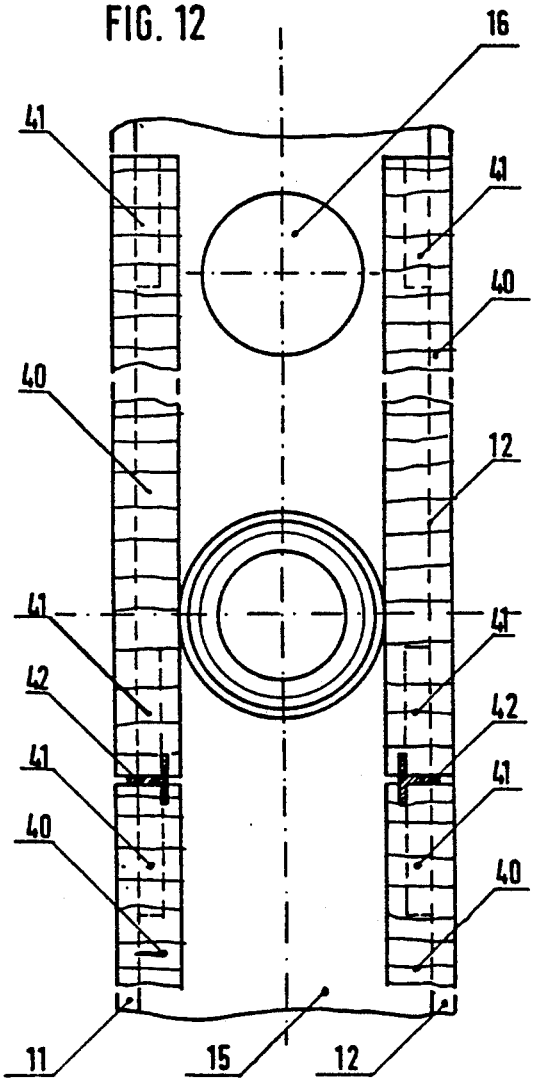
FIG.13
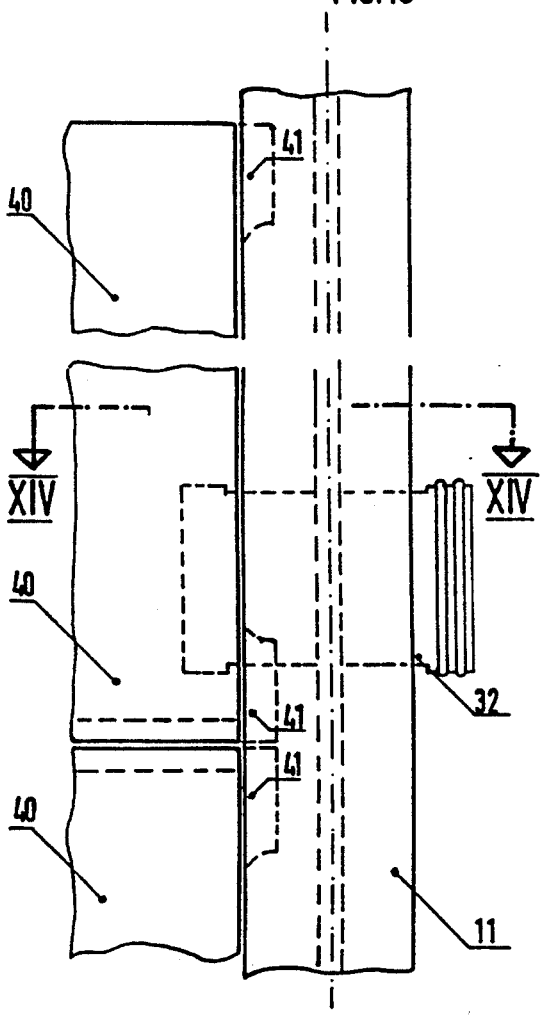
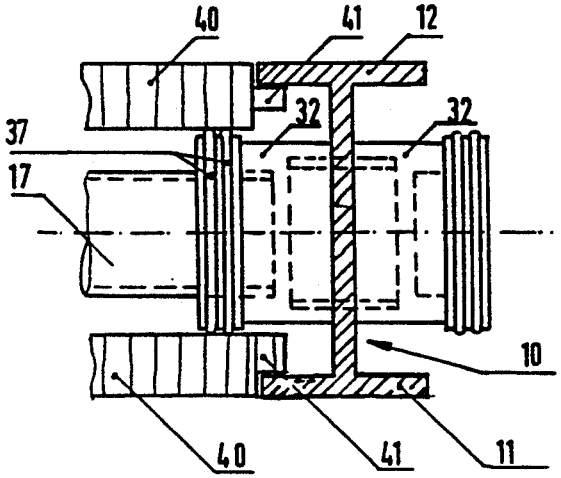
FIG. 14

PARTITIONING SYSTEM

BACKGROUND OF THE INVENTION

1. Field of the Invention

This invention relates to a partitioning system with vertical posts and horizontal connecting tubes, where panels be attached to the posts with connecting elements. The posts having a connecting bar which is perpendicular to the plane of the partition with a row of connecting bores. Cantilevered arm elements, which extend perpendicular with respect to the partition plane can be attached to the posts.

2. Description of Prior Art

In one known support arm system the panels connected with the posts do not form a unified flat surface. Here the posts are also put together from two profiled sections and form vertical separating seams in the visible area, which is increased by the distance between the panels attached to the posts, because the panels protrude also with respect to the support bars of the posts from the surfaces of the partitioning system. Moreover, securing elements which protrude from the surfaces of the partitioning system are required to connect the panels with the posts, Another disadvantage which greatly impairs the visual appearance of such partitioning system is in that, in their shape as simple bows of circular tube sections, the cantilevered arm elements do not adjoin the posts in accordance with the system and can also not be used as bases for the posts.

SUMMARY OF THE INVENTION

It is this object of this invention to provide a partitioning system where panels form a unified surface with posts and cantilevered arm elements can be used universally, such as for bases, for the posts. It is another object of this invention that no connecting elements between the panels and the posts be apparent on the visible side of the partition.

The above and other objects of this invention are attained in accordance with a connecting bar that has at least one support bar oriented in the plane of the partition. The connecting elements can be assembled from a threaded part which can be inserted into a bore of the connecting bar and from two screw sockets, which can be screwed on the threaded part from both sides of the post. The screw sockets have a diameter which is larger than the diameter of the bores and can be clamped to the connecting bar of the post. The screw sockets have, at a distance corresponding to the thickness of the cantilevered arm elements from the front facing the threaded part, a shoulder with a widened diameter. The cantilevered arm elements have vertical slits for receiving the support bars of a post and of a bore for the screw socket in the area outside of the shoulder where, when the cantilevered arm elements have been pushed on the post, the bore can be aligned with a bore of the connecting bar and the cantilevered arm element can be connected with the post with a connecting element. The panels can be fixed between the support bars of the posts and the shoulders of the screw sockets with connecting elements positioned on the posts.

The panels are covered by the support bars of the posts, so that a unified visible surface is created. The connecting elements fixed on the connecting bars of the posts are also covered, but they form receptacles for the panels together with the support bars of the posts, in which the panels are kept. A completely flush visible surface can be achieved in the partitioning system according to this invention, since the front ends, facing the posts of the panels have connecting shoulders, which are set back in relation to the visual side of the panel by the thickness of the support bars of the posts.

The cantilevered arm elements can also be fastened to a post with the connecting elements, where the support bars inserted into the slits of the cantilevered arm element define the protruding position of the cantilevered arm element from the post. The cantilevered arm element can be attached at any location on the post which is distinguished by a bore in the connecting bar. In this manner, the cantilevered arm elements can be used as a base for the post or as a bearing element for additions to the partitioning system.

In accordance with a further embodiment, a partitioning system which is closed on both visible sides is achieved since the posts are embodied as sections of a double-T-support, where the connecting bar has support bars on both ends, which protrude perpendicularly from both sides and where the clear distance between the support bars corresponds to the sum of the diameter of the shoulders of the screw sockets and twice the thickness of the panels in the connecting area.

If the panels have connecting shoulders, the support bars of the posts can end flush with the panels on both sides of the partition.

In accordance with one embodiment, clamping of the panels between the shoulders of the screw sockets and the support bars of the posts is easily attained since the shoulders of the screw sockets have grooves for receiving elastic rings.

The connection of the posts with each other is made, in accordance with one embodiment, with the screw sockets being provided in the area of the front face towards the shoulder with a plug connection for a connecting tube, which can be fixedly seated in the plug connection with a snug and/or press fit. In this embodiment, the length of the connecting tubes determines the distance between adjoining posts, such as the width of the sections of the partitioning system and thus also the width of the panels.

The connection of the connecting tubes with the screw sockets of the connecting elements which are aligned with each other is simplified since the plug connections of the screw sockets have insertion aids.

A defined connection position is assured since a partition in the screw socket separates the plug connector from a threaded connector. The partition limits the insertion movement of the connecting tube.

So that the cantilevered arm elements, together with the connecting elements comprising two screw sockets and a threaded part, can be attached to the posts, the width of the support bars protruding from the connecting bar is less than the thickness of the cantilevered arm elements, and the depth of the slits in the cantilevered arm elements corresponds to the width of the support bars protruding from the connecting bar.

The cantilevered arm elements can be such, that the cantilevered arm element protrudes on one side from the post, extends over the post and has two slits for receiving the support bars of the post and a bore between the slits. This preferred embodiments of a one-sided cantilevered arm element protrudes from only one side of the partition and can be used as a one-sided base for a post.

But if the cantilevered arm element protrudes from the post on both sides and has in the central area two slits for receiving the support bars of the post and a bore between the slits, the cantilevered arm elements protrude from both sides of the partition in the same place and can be used as a two-sided base for a post.

In accordance with a further embodiment of this invention, the cantilevered arm elements protruding on one side can be designed in such a way, that the cantilevered arm element protrudes on one side from the post, extends over one half of the connecting leg of the post and has a slit for receiving a support bar and half a bore.

If in connection with the cantilevered arm element the cantilevered arm element extends with one side perpendicularly to the slits, while the opposite side is inclined towards the free end or free ends of the cantilevered arm element in such a way that the cantilevered arm element tapers, then the side perpendicular to the slits is turned up for use as a cantilevered arm, while it is turned down for use as a base.

If the panels are to extend over only a portion of the height of the posts, according to a further embodiment, support elements can be fixed between the connecting bar of a post and the shoulder of a screw socket of a connecting element fastened on the post, which have a semicircular receptacle for the screw socket in the area outside the shoulder and are supported by a bar on the facing support bar of the post at both sides of the bar, a receptacle for a panel is formed, which is closed off at the bottom with a support plate. These support elements form stops together with the support plates which define the position of the lower edge of the panel with respect to the posts. In this case it is recommended that the panels have connecting shoulders, which are supported on the support plates, in the facing end areas.

If one embodiment is such, that the bar of the support element is fastened in the center of the thickness of the support element and provides equal divisions, which are closed off at the bottom by means of support plates, for receiving panels towards both front ends of the support element, and that the thickness of the support elements approximately corresponds to the width of the support bars protruding from the connecting bar of the posts and approximately to the length of the screw sockets in the area outside of the shoulder then a uniform support element can be used for both visible sides of the partition. In this preferred embodiment the support element is only used in two positions which are turned by 180°, and two support elements can be fastened on the post with the same screw socket of the connecting element.

In accordance with another preferred embodiment, the sections of the partition are set up in arbitrary angular positions to each other in that immediately adjacent posts of two partition sections can be connected with each other with hinge elements of a hinge at arbitrary angles, where the hinge elements terminate in plug shoulders, which can be inserted into the plug connections of screw sockets of connecting elements which have been fastened on the two posts and can be fixed there and are hingedly connected with each other. The connecting elements are also used for fastening the hinge on the shoulders.

In accordance with a further embodiment, equipping the partition sections with hinges can be provided such, that adjoining posts can be connected with each other with coupling elements which terminate on both ends in plug shoulders, which can be inserted into the connecting elements of screw connections fixed on both posts and fastened. The two plug shoulders of a coupling element are connected with each other with an elastic, deflectable intermediate piece. In this embodiment the plug shoulders and the elastic intermediate piece can also be made of one piece and have a through-bore which makes it possible to conduct electrical cables or the like through them.

The last partition section of a partition can terminate in a visually clean manner when sections of a double-Tsupport are used and the free side of the post can be covered with a cover section which is generally U-shaped in cross section

BRIEF DESCRIPTION OF DRAWINGS

This invention will be described in detail by preferred embodiments shown in the drawings. Wherein

FIG. 5 is a partial sectional which shows the installation of the partial panels on a post with support elements;

FIG. 6 is the view of the connecting parts in accordance with FIG. 5 looking on the visible side of the panels;

FIG. 7 is a view of a partial section through the connection place in accordance with FIG. 5, looking perpendicularly with respect to the visible side of the panels;

FIG. 10 is a sectional view of the installation of another embodiment a one-sided cantilevered arm element as the base of a post;

FIG. 11 is a side view of the connection place in accordance with FIG. 10 in a lateral view;

FIG. 12 is a cross-sectional view taken perpendicularly with respect to the visible side of the panels of the installation of partial panels on the post which is flush on both sides with the support bars of the post;

FIG. 13 is a side view of the connection area in accordance with FIG. 13, looking on the visible side of the partial panels;

FIG. 14 is a partial cross sectional view along the line XIV—XIV of FIG. 13;

DESCRIPTION OF PREFERRED EMBODIMENTS

Figure 1:
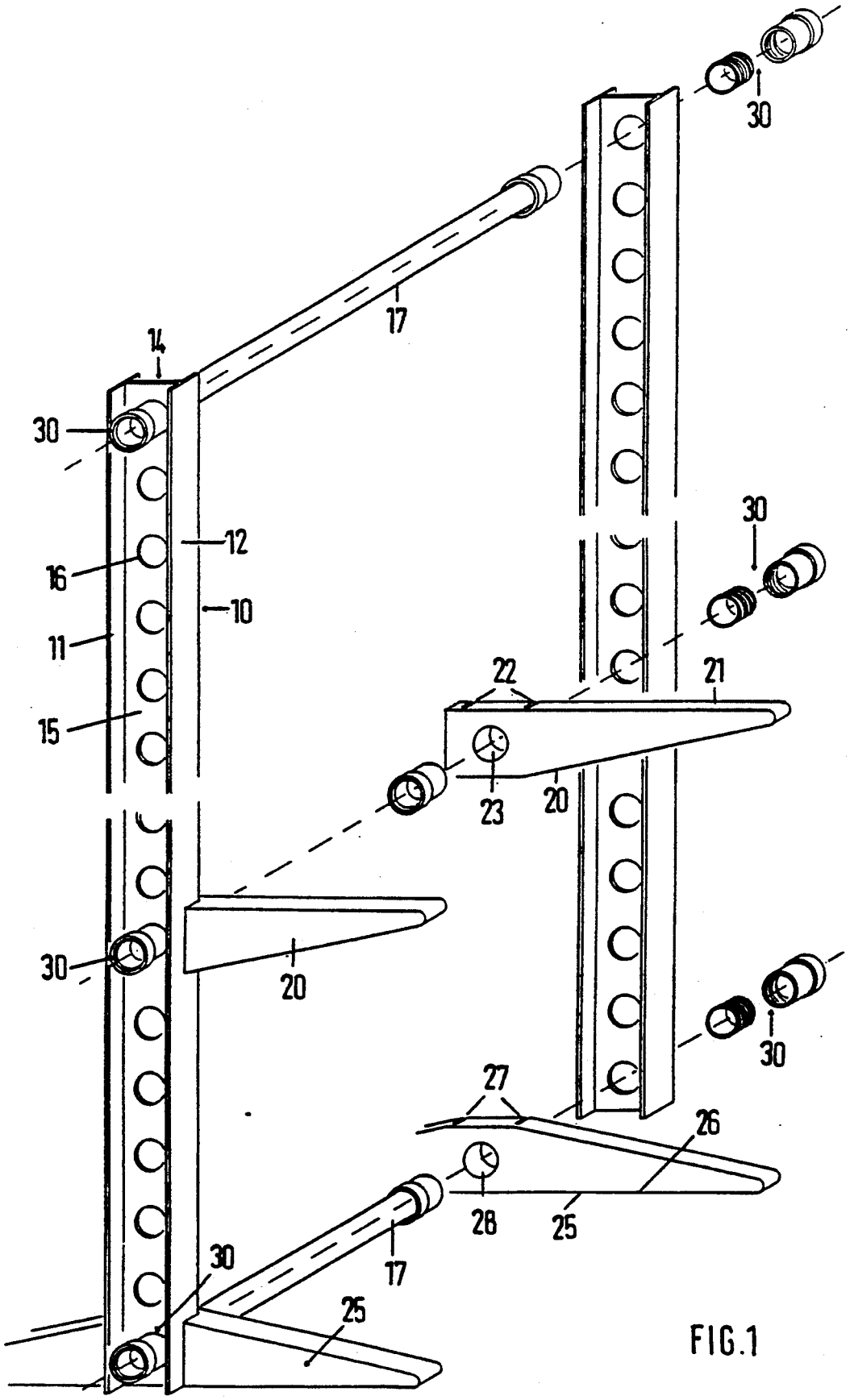
FIG. 1 is a perspective exploded view of the connection of the two posts of a partition section with the installation of cantilevered arm elements.

Sections of a double-T-support are used as posts 10 in one preferred. But the post 10 can also be produced from an L-shaped or only T-shaped cross sectional part. It is only important that the post 10 has a connecting bar 15 extending perpendicularly to the visible sides of the partition with a row of preferably evenly distributed bores 16 and at least one support bar 11 or 12 extending perpendicularly thereto. In the preferred embodiment shown in FIG. 1, the support bars 11 and 12 on both ends of the connecting bar 15 project perpendicularly with the same width at both sides of the connecting bar 15.

The two posts 10 of a partition section are connected with each other with two connecting tubes 17, preferably with connecting elements 30 which are fixed in a bore 16 of the posts 10, as will be shown later.

Receptacles 14 receiving the connecting elements 30 and which are also used for installing the panels, also to be shown and discussed below, are formed between the support bars 11 and 12 and the connecting bar 15 of a post.

One-sided cantilevered arm elements 20 or two-sided cantilevered arm elements 25 can also be fastened on the posts 10 by means of the connecting elements 30. Here, the two-sided cantilevered arm element 25 can be fastened together with the lower connecting tube 17.

Figure 2:
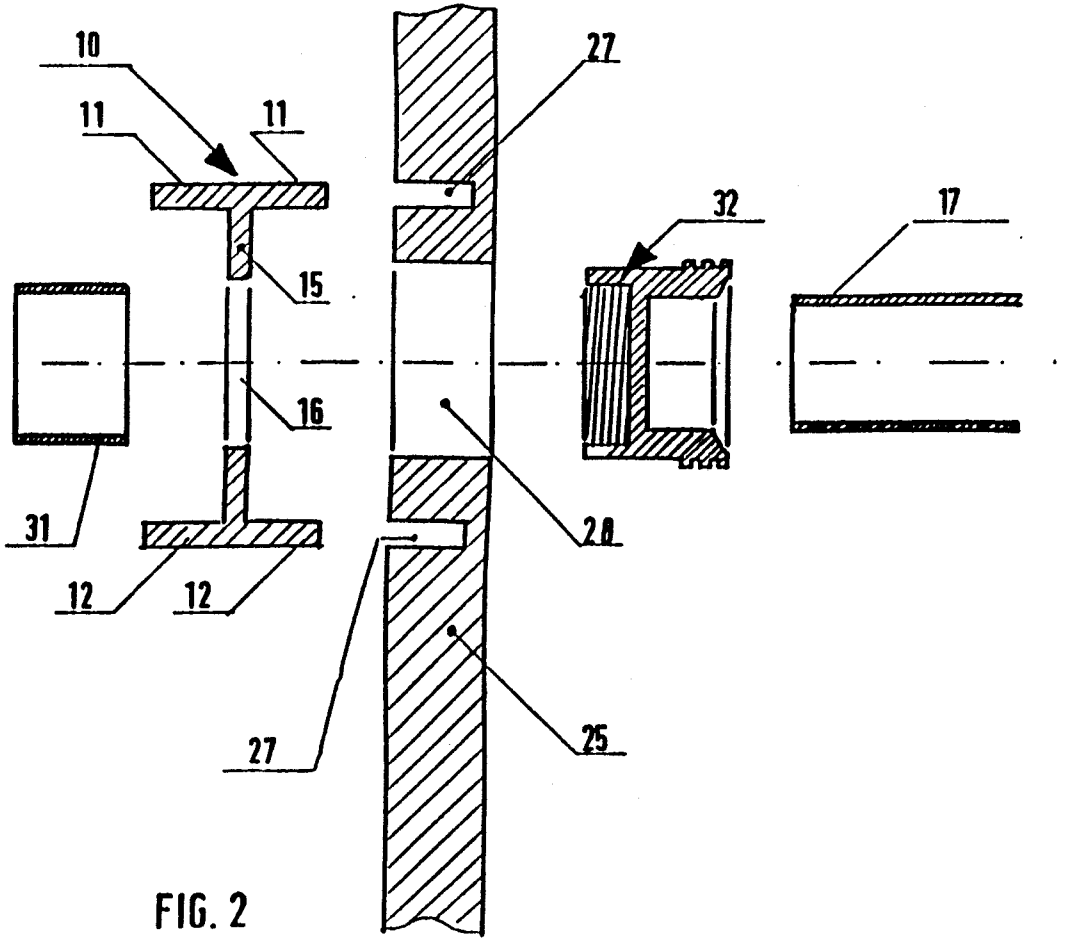
FIG. 2 is a sectional exploded view of the installation of a two-sided cantilevered arm element and a connecting tube of a connecting element on a post.
Figure 3:
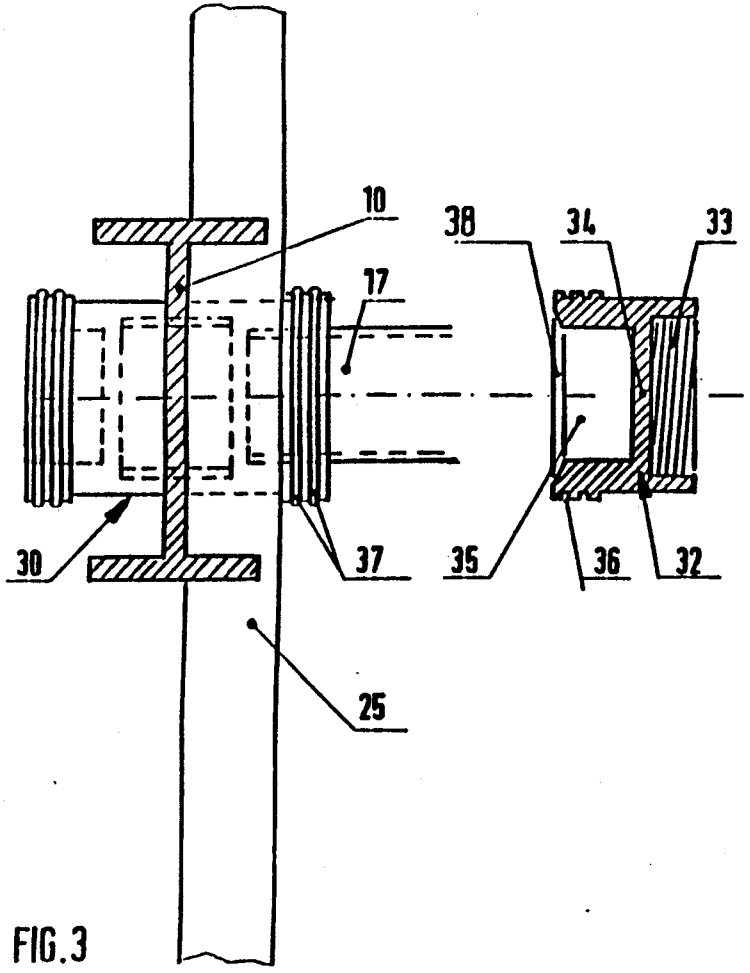
FIG. 3 is a partial cross view of the connection made in accordance with FIG. 2.
Figure 4:
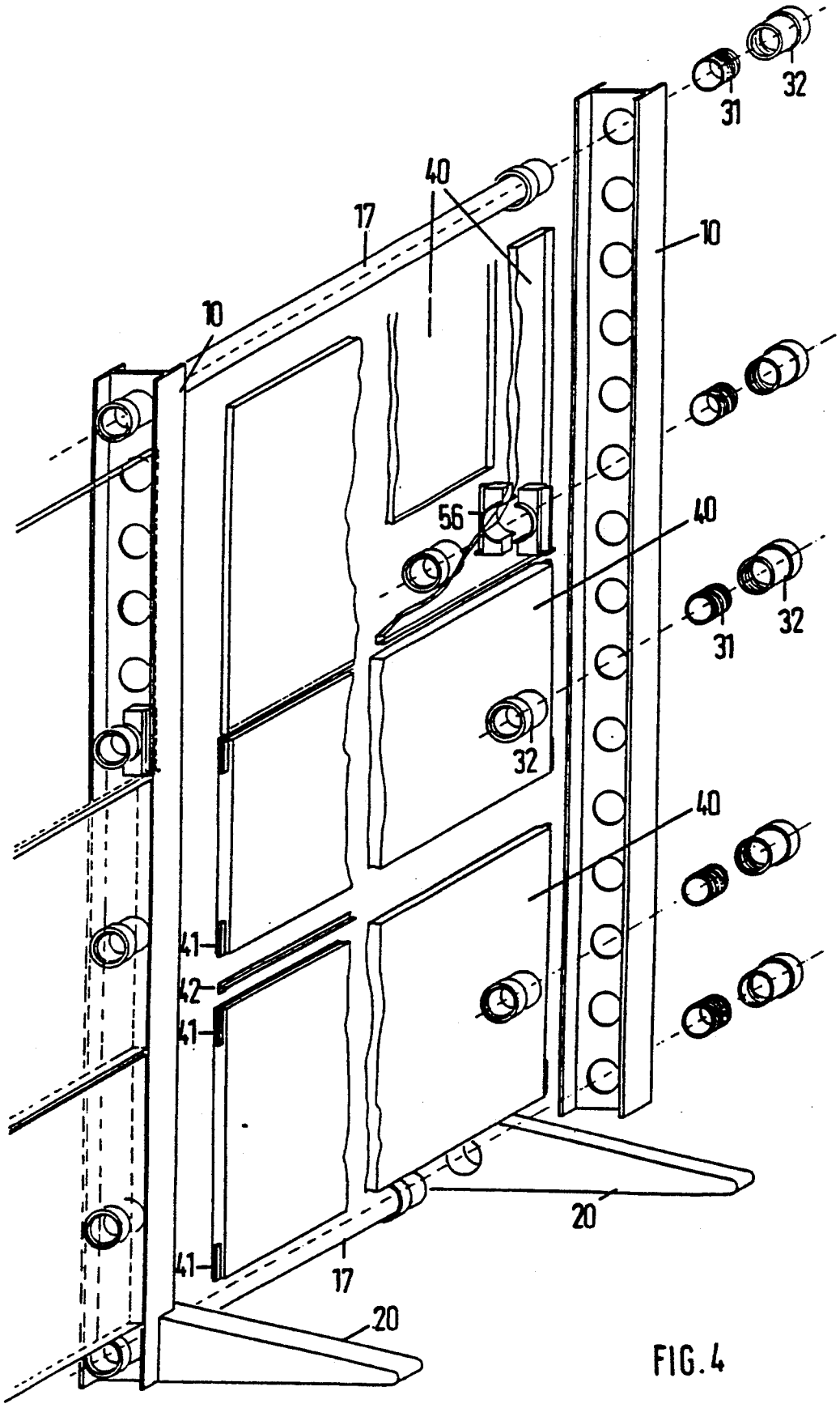
FIG. 4 is an exploded perspective view of a partition section with panels which only extend over a portion of the height of the posts.

As FIGS. 2 and 3 show, a connecting element 30 comprises a threaded coupling 31, which can also be embodied as a threaded socket, and two screw sockets 32. The screw sockets 32 can be screwed onto the threaded coupling 31 by means of their inner threads 33 with, the partition 34 towards the plug connection 35 limiting the screwing motion. The diameter of the threaded coupling 31 is adapted to the diameter of the bores 16 in the connecting bar 15 of the posts 10. Therefore, the screw sockets 32 can be fastened by means of the inner threads 33 by the front ends facing the post 10 on the connecting bar 15 if they are screwed from both sides onto the threaded, coupling 31 inserted into the bore 16. The plug connections 35 of the screw sockets 32 are provided with insertion aids 38, which make insertion of the connecting tube 17 easier. The connecting tube 17 is maintained in section with a snug and/or press fit in the plug connection 35 of the screw socket 32. The outer diameter of the screw sockets 32 is adapted to the inner diameter of the bores 23 and 28 of the cantilevered arm elements 20 and 25, so that the screw socket 32 can be inserted into the bore 23 or 28 of a cantilevered arm element 20 or 25 until it is stopped at the widened shoulder 36. The length of the screw socket 32 outside of the shoulder 36 is adapted to the thickness of the cantilevered arm elements 20 and 25, so that the cantilevered arm elements 20 or 25 can be fixedly connected with the post 10. The cantilevered arm elements 20 or 25 have vertical slits 22 or 27 which receive the support bars 11 and 12 of the post 10. The screw socket 32 is supported on the connecting bar 15 of the post 10, and the shoulder 36 of the screw socket 32 is supported on the side of the cantilevered arm element 20 or 25 facing away from the post 10. The shoulder 36 of the screw sockets 32 has grooves which receive elastic rings 37. In this case the one-sided cantilevered arm element 20 protrudes from one side of the post 10, the upper side 21 extending horizontally, while the lower side is inclined in such a way that the cantilevered arm element 20 tapers toward the free end. If the cantilevered arm element 20 is rotated by 180°, so that the side 21 faces downward, it can also be used as a onesided base element. The double-sided cantilevered arm element 25 is similarly designed, but extends on both sides of the partition. If used as a base element, the horizontal side 25 is downwardly oriented and if used as a cantilevered arm, upwardly oriented.

The installation of partial panels 40 on the posts 10 is explained by referring to FIGS. 4 to 7, where support elements 56 are fastened on the posts 10 by means of connecting elements 30. These connecting elements 30 have a semicircular receptacle 53, with which they enclose half of the screw sockets 32 outside of the shoulder 36 and are supported by means of a bar 52 on the inside of the facing support bar 11 or 12. Receptacles are formed on both sides of the bar 52, which is disposed in the center of the thickness of the support element 56, and receive the partial panels 40 and support them by means of the support plates 51. The support plates 51 downwardly close off the receptacles, disposed on both sides, for the partial panels 40. The partial panels 40 are inserted as far as the bar 52 and are maintained between the support bars 11 and 12 and the elastic rings 37 in the shoulder 36 of the screw socket 32.

As FIGS. 12 to 14 show, on the front ends facing the posts 10, the partial panels 40 can also extend into the receptacle 14 of the post 10 only with the connecting shoulders 41. In this case the connecting shoulders 41 are set back from the visible side of the partial panels 40 by the thickness of the support bars 11 and 12, so that the support bars 11 and 12 of the posts 10 and the visible sides of the partial panels 40 transition flush into each other. The panels can of course extend over the entire height of the posts 10. As shown by FIG. 12, the partial panels 40 can be connected with each other by T-shaped rails 42. With their elastic rings 37 in the shoulder 36, the screw sockets 32 of the connecting elements 30 push the partial panels 40 against the inside of the support bars 11 and 12, so that the connecting shoulders 41 are pressed against them. The connecting element 30 in the area of the lower bore of the post 10 can again be used for receiving the connecting tube 17.

Figure 8:
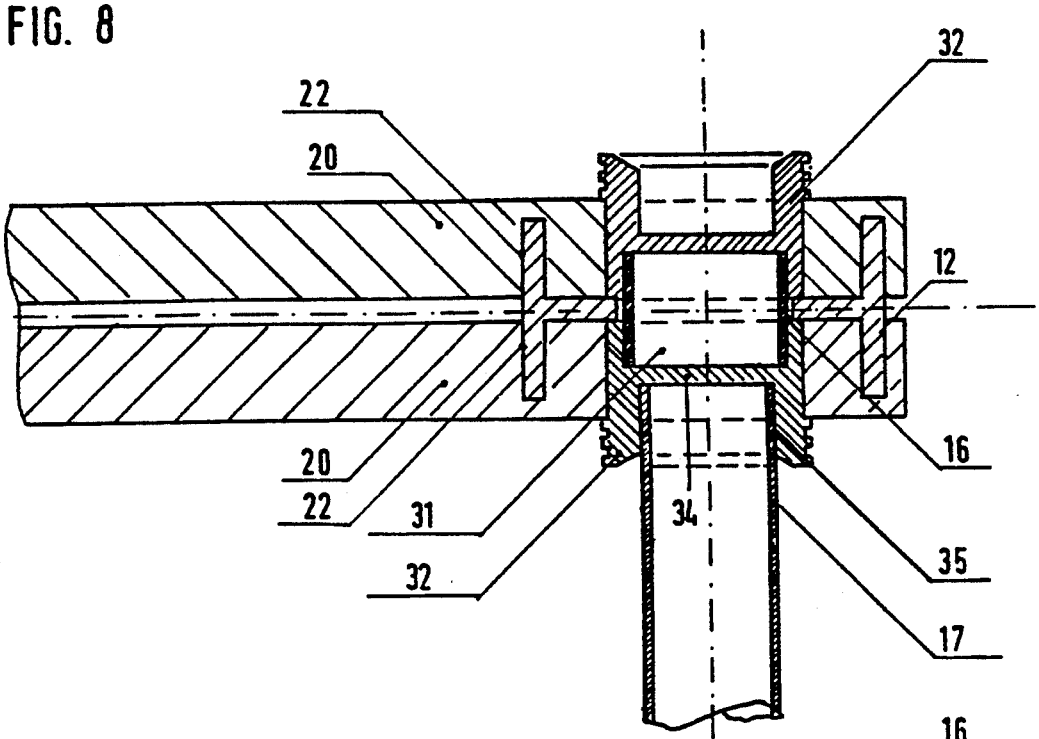
FIG. 8 is a sectional view of the installation of a base assembled from two one-sided cantilevered arm elements on a post, where the connecting element is simultaneously used for receiving the connecting tube.
Figure 9:
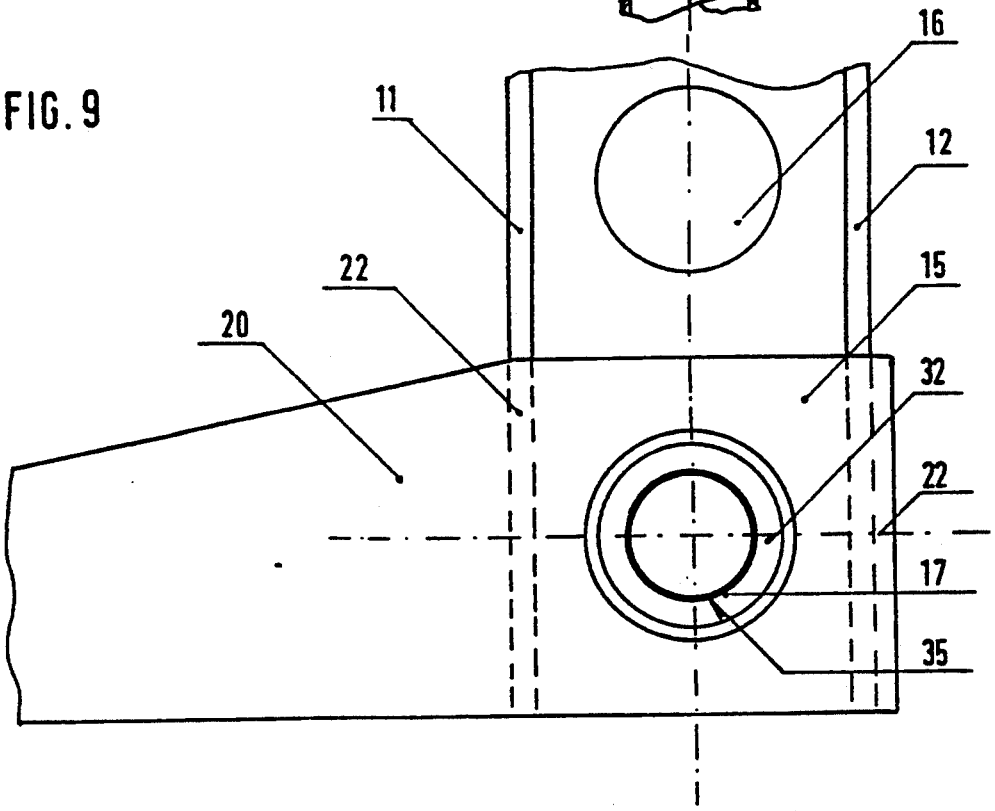
FIG. 9 is a side view of the connection area in accordance with FIG. 8.

FIGS. 8 and 9 show the installation of a base, assembled from two one-sided cantilevered arm elements 20, on the post 10. With their sides provided with the slits 22 facing each other, the cantilevered arm elements 20 are pushed on the support bars 11 and 12 of the post 10. The threaded coupling 31 is inserted into the lowest bore 16 of the post 10 and extends out of both sides of the connecting bar 15. A screw socket 32 is inserted from both sides through the bores 23 of the cantilevered arm element 20 and is screwed on the threaded coupling 31. The shoulders 36 of the screw sockets 32 cover the bores 23 of the cantilevered arm elements 20, so that they are braced on the post 10 and in this way fixed. The downwardly placed horizontal sides 21 of the cantilevered arm elements 20 are flush with the lower end of the post 10. The one screw socket 32 receives the lower connecting tube 17 in its plug connection 35.

Another embodiment of the cantilevered arm element 20' is shown in FIGS. 10 and 11. The cantilevered arm element 20' only extends as far as the center axis of the connecting bar 15 of the post 10 and therefore has only one vertical slit 22, which receives the support bar 11 or 12, depending from which side of the post 10 the cantilevered arm element 20' protrudes out. The base of the post 10 comprises a single cantilevered arm element 20'. Securement of the cantilevered arm element 20' on the post 10 by means of the connecting element 30 does not differ from securement of the two cantilevered arm elements 20 of FIGS. 8 and 9.

Figure 16:
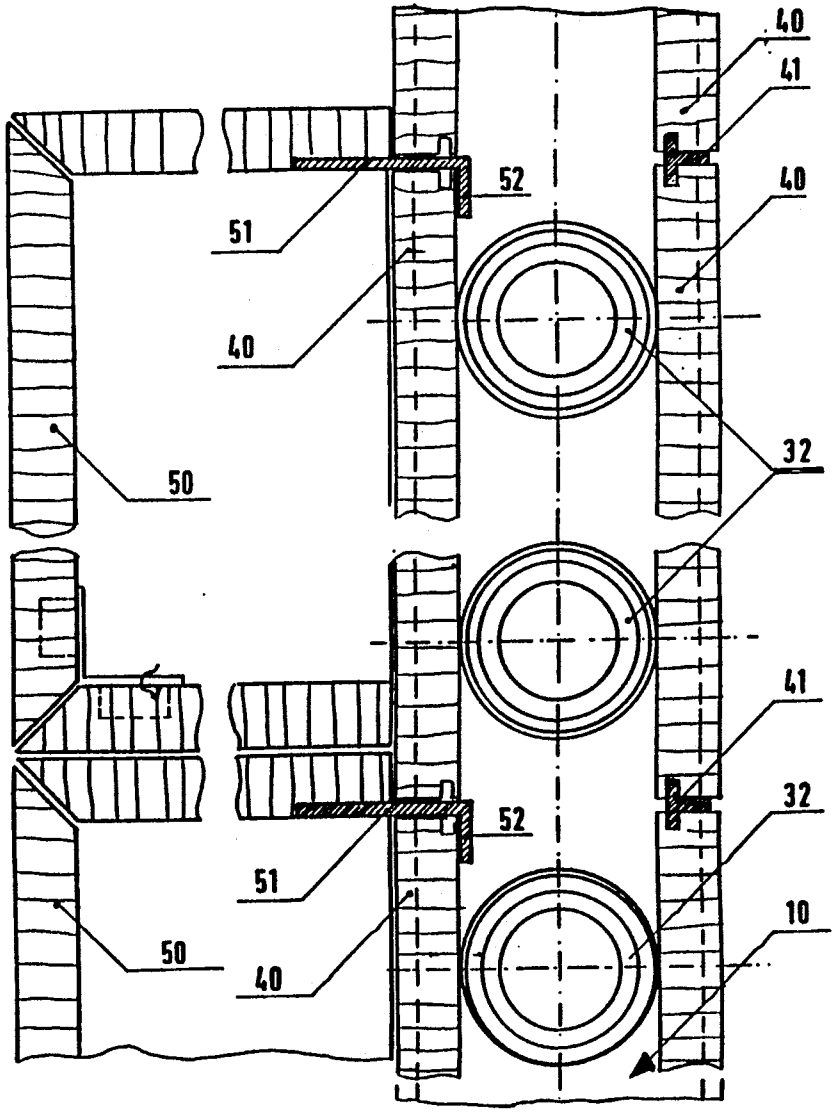
FIG. 16 is a sectional view, perpendicularly with respect to the visible side of the partial panels, of the installation of the box-shaped furniture piece in accordance with FIG. 15.
Figure 15:
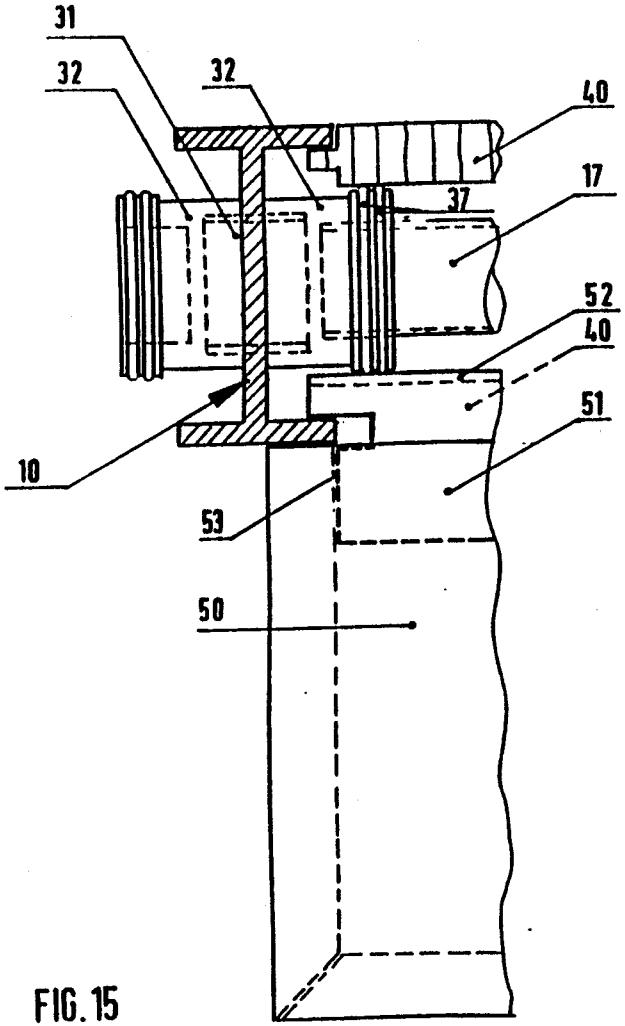
FIG. 15 is a top view of the installation of a box-shaped furniture piece on a partial panel fastened on posts.

FIGS. 15 and 16 show how box-shaped furniture pieces 50 can be fixed on the partition. Angle irons 51 are disposed on the back of the furniture piece 50, which protrude from the back in the form of hangers 52. The furniture piece 50 is hung from the top edge of a partial panel 40 by means of the hanger 52 which extends over the width of the furniture piece 50. As FIG. 15 shows, the angle iron 50 is provided on both front ends with a cutout 53, into which the support bar of the post 10 is inserted. The furniture piece 50 is supported by the post 10, so that the partial panel 40 is relieved of the tilting moment of the furniture piece 50. The furniture piece 50 can also extend over the outside of the support bar.

Figure 18:
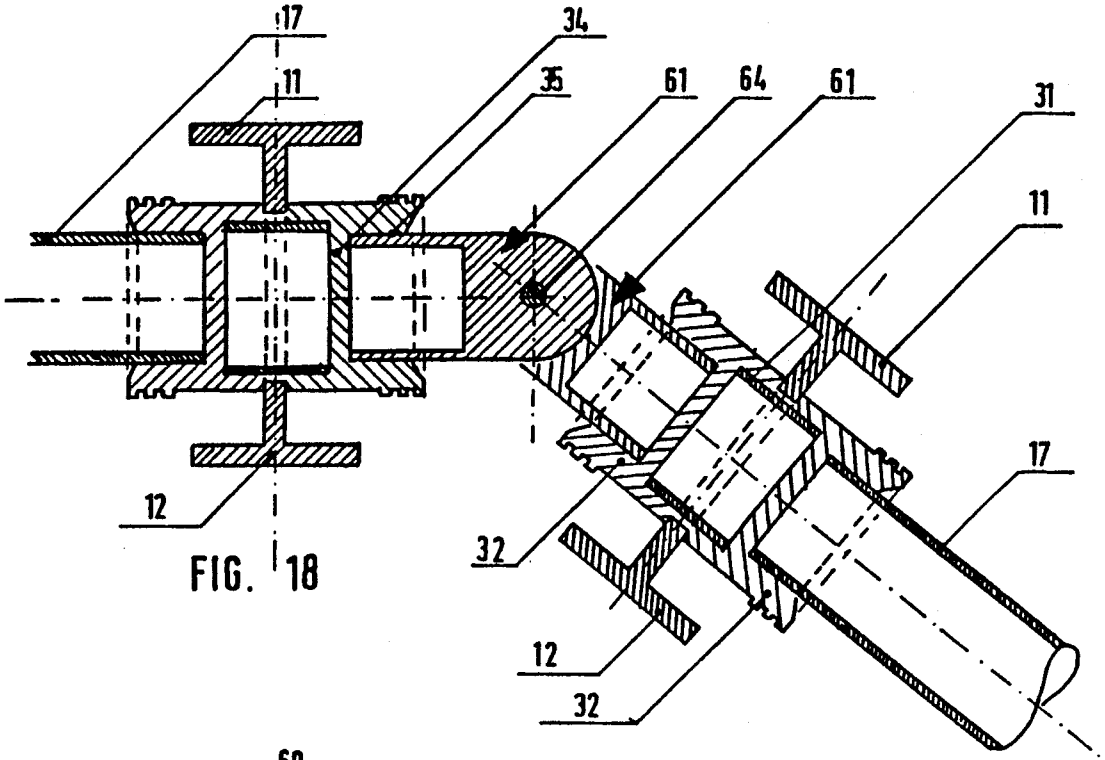
FIG. 18 is a sectional view of the hinge connection in accordance with FIG. 17 in a different angular position of the partition sections.
Figure 19:
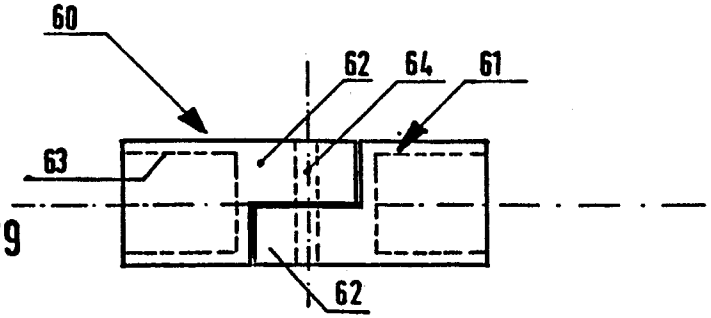
FIG. 19 is a front view of the hinge employed in FIGS. 17 and 18.
Figure 17:
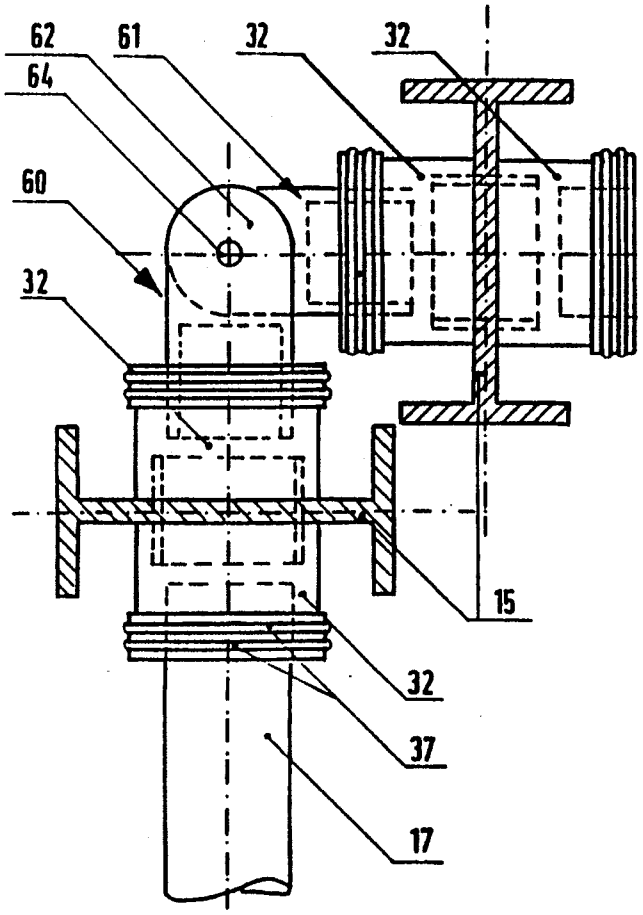
FIG. 17 is a sectional view of a hinge connection between the directly adjoining posts of two partition sections which are at right angles with respect to each other.

FIGS. 17 to 19 show how two adjoining partition sections can be set up at any arbitrary angle, with respect to each other. If, in a continuous partition, two partition sections are aligned in one plane, a single post 10 will suffice at the transition point of the partition sections. In case of angled positioning of the two partition sections, each partition section should be closed off by a post 10 in the area where they meet. Hinges 60 can take over the coupling of the two partition sections with the aid of two connecting elements 30 each. FIG. 19 shows one preferred embodiment of a hinge 60 comprising two hinge parts 61. The hinge parts 61 terminate in hinge brackets 62, which are hingedly connected with each other by means of the link pin 64. The hinge parts 61 are themselves embodied as plug elements, which can be inserted into the plug connection 35 of the screw sockets 32 and fixed in it, as can be clearly seen in the sectional view in FIG. 18. The hinges 60 are preferable connected with the connecting elements 30 in such a way, that the link pins 64 are vertically oriented. The partition sections then can be placed in any arbitrary angular position with respect to each other, as shown in FIGS. 17 and 18. The connecting elements 30, which also receive the connecting tubes 17, can also be employed for this.

The hinges can also be embodied differently. It is only important that the hinge parts terminate in plug tangs and by means of these can be coupled with the connecting elements 30. Here the plug tangs can also be connected in one piece with an elastic intermediate section, such as a film hinge or the like.

The posts 10 disposed at the ends of the partition can be covered with a U-shaped cover element, so that the connecting elements are also not visible in these areas.

The exemplary embodiments illustrated are not to be considered as a limitation of the invention. For example, the connecting bores in the posts can also be embodied as connecting receptacles which have a polygonal cross section, and the threaded part of the connecting element can be made of one piece with one of the two screw sockets.

If an improved closing in the area of a connecting element is to be achieved, the bore of the cantilevered arm element, most have a widened section facing the shoulder of the screw socket, which receives at least a part of the shoulder of the screw socket.

I claim:

1. In a partitioning system having vertical posts and horizontal connecting tubes, where panels are attachable to the posts with connecting elements, the posts having a connecting bar which is perpendicular to a plane of the partition with a row of connecting bores, and cantilevered arm elements which extend perpendicular with respect to the partition plane can be attached to the posts, the improvement comprising:

the connecting bar (15) having at least one support bar (11, 12) oriented in the plane of the partition;

the connecting elements (30) comprising a threaded coupling (31) insertable within one said bore (16) of the connecting bar (15) and two screw sockets (32), said screw sockets (32) screwed on the threaded coupling (31) from both sides of the post (10), where said screw sockets (32) have an outside diameter which is larger than an inside diameter of the bores (16);

said screw sockets (32) having at a distance corresponding to a thickness of the cantilevered arm elements (20, 20', 25) from a front facing said threaded coupling (31) a shoulder (36) with a widened diameter;

the cantilevered arm elements (20, 20', 25) having vertical slits (22, 27) for receiving the support bars (11, 12) of a post (10) and and having an arm bore (23, 28) for the screw socket (32) in an area outside of the shoulder (36), said arm bore (23, 28) aligned with one corresponding said bore (16) of the connecting bar (15), and the cantilevered arm element (20, 20', 25) connectable with the post (10) with one said connecting element (30); and at least one panel (40) fixable between the support bars (11, 12) of the posts (10) and said shoulders (36) of said screw sockets (32) with said connecting elements (30) disposed on the posts (10).

2. In a partitioning system in accordance with claim 1, wherein the posts (10) each comprise the connecting bar (15) having one of said support bars (11, 12) on each of both ends of each of the posts (10), said support bars (11, 12) protruding perpendicularly from both sides of the post (10) and a clear distance between the support bars (11, 12) corresponds to the sum of an outside diameter of said shoulders (36) of said screw sockets (32) and twice the thickness of said panels (40).

3. In a partitioning system in accordance with claim 2, wherein said shoulders (36) of said screw sockets (32) each have a groove for receiving an elastic ring (37).

4. In a partitioning system in accordance with claim 3, wherein said screw sockets (32) have in an area of a front face towards said shoulder (36) a plug connection (35) for a connecting tube (17), and said connecting tube (17) is seatable in said plug connection (35) with at least one of a snug fit and a press fit.

5. In a partitioning system in accordance with claim 4, wherein each of said plug connections (35) of said screw sockets (32) have an insertion aid (38).

6. In a partitioning system in accordance with claim 5, wherein a partition (33) in said screw socket (32) separates said plug connector (35) from a threaded connector (33).

7. In a partitioning system in accordance with claim 6, wherein a width of the support bars (11, 12) protruding from the connecting bar (15) is less than a thickness of each of the cantilevered arm elements (20, 20', 25), and a depth of said slits (22, 27) in the cantilevered arm elements (20, 20', 25) corresponds to said width of the support bars (11, 12) protruding from the connecting bar (15).

8. In a partitioning system in accordance with claim 7, wherein each said cantilevered arm element, (20) protrudes on one side from the post (10) extends over the post (10) and has two said slits (22) for receiving the support bars (11, 12) of the post (10) and one said bore (28) between said slits (22).

9. In a partitioning system in accordance with claim 7, wherein the cantilevered arm elements (25) protrude from the post (10) on both sides and each has in a central area two said slits (27) for receiving the support bars (11, 12) of the post (10) and said arm bore (28) is between said slits (22).

10. In a partitioning system in accordance with claim 7, wherein each said cantilevered arm element (20') protrudes on one side from the post (10), extends over one half of the connecting bar (15) of the post (10) and has said slit (22) for receiving one said support bar (11 or 12) and one-half of said arm bore (28).

11. In a partitioning system in accordance with claim 10, wherein each said cantilevered arm element (20, 21', 25) extends with one side (21, 26) perpendicularly with respect to said slits (22, 27) and an opposite side inclined towards at least one free end of the cantilevered arm element (20, 20', 25) is such a way that the cantilevered arm element (20, 20', 25) tapers.

12. In a partitioning system in accordance with claim 11, wherein a plurality of support elements (56) are fixable between the connecting bar (15) of the post (10) and said shoulder (36) of one said screw socket (32) of said connecting element (30) fastened on the post (10), each said support element (56) has a semicircular receptacle (53) for said screw socket (32)in an area outside said shoulder (36) and is supported by a bar (52) on a facing said support bar (11 or 12) of the post (10), and at both sides of said bar (52) a-receptacle for said panel (40) is formed, which is closed off at a bottom with a support plate (51).

13. In a partitioning system in accordance with claim 12, wherein said bar (52) of said support element (56) is fastened in a center of a thickness of said support element (56) and provides equal divisions, which are closed off at said bottom by support plates (51), and said thickness of said support elements (56) approximately corresponds to a width of the support bars (11, 12) protruding from the connecting bar (15) of the posts (10) and approximately to a length of said screw sockets (31) in an area outside of said shoulder (36).

14. In a partitioning system in accordance with claim 13, wherein immediately adjacent said posts (10) of a two partition section are connectable with each other with a plurality of hinge elements (61) of a hinge (60) at arbitrary angles, where said hinge elements (61) terminate in plug shoulders which are insertable into said plug connections (35) of said screw sockets (31) of said connecting elements (30) which are fastened on the two posts (10) and are hingedly connected with each other.

15. In a partitioning system in accordance with claim 13, wherein the adjoining posts (10) are connectable with each other by a plurality of coupling elements which terminate on both ends in plug shoulders, which are insertable into the connecting elements (35) of screw connections (31) fixed on both posts (10) and fastened there, and two said plug shoulders of said coupling element are connected with each other with an elastic, deflectable intermediate piece.

16. In a partitioning system in accordance with claim 15, wherein a free side of the post (10) is covered with a cover section which is generally U-shaped in cross section.

17. In a partitioning system in accordance with claim 16, wherein on front ends facing the posts (10) the panels (40) have connecting shoulders (41) which are set back in relation to a visual side of the panel (40) by a thickness of the support bars (11, 12) of the posts (10).

18. In a partitioning system in accordance with claim 17, wherein a plurality of furniture pieces (50) are suspended by a plurality of angled profiled sections (51) from a top edge of partial panels (40), which protrude from a back of each said furniture piece (50) in the form of hangers (52).

19. In a partitioning system in accordance with claim 18, wherein said bores (16) of the posts (10) are polygonal in cross section.

20. In a partitioning system in accordance with claim 19, wherein said threaded coupling (31) forms one piece with one of said two screw sockets (32).

21. In a partitioning system in accordance with claim 20, wherein said arm bore (23, 28) of one of the cantilevered arm elements (20, 20', 25) has a widened section facing said shoulder (36) of said screw socket (32), which receives at least a part of said shoulder (36) of said screw socket (32).

22. In a partitioning system in accordance with claim 1, wherein said shoulders (36) of said screw sockets (32) each have a groove for receiving an elastic ring (37).

23. In a partitioning system in accordance with claim 1, wherein said screw sockets have a plurality of plug connections, and each of said plug connections (35) has an insertion aid (38).

24. In a partitioning system in accordance with claim 1, wherein a partition (33) in said screw socket (32) separates a plug connector (35) from a threaded connector (33).

25. In a partitioning system in accordance with claim 1, wherein a width of the support bars (11, 12) protruding from the connecting bar (15) is less than a thickness of each of the cantilevered arm elements (20, 20', 25), and a depth of said slits (22, 27) in the cantilevered arm elements (20, 20', 25) corresponds to said width of the support bars (11, 12) protruding from the connecting bar (15).

26. In a partitioning system in accordance with claim 25, wherein each said cantilevered arm element (20) protrudes on one side from the post (10), extends over the post (10) and has two said slits (22) for receiving the support bars (11, 12) of the post (10) and one said bore (28) between said slits (22).

27. In a partitioning system in accordance with claim 25, wherein the cantilevered arm elements (25) protrude from the post (10) on both sides and each has in a central area two said slits (27) for receiving the support bars (11, 12) of the post (10) and said arm bore (28) is between said slits (22).

28. In a partitioning system in accordance with claim 25, wherein each said cantilevered arm element (20') protrudes on one side from the post (10), extends over one half of the connecting bar (15) of the post (10) and has said slit (22) for receiving one said support bar (11 or 12) and one-half of said arm bore (28).

29. In a partitioning system in accordance with claim 1, wherein each said cantilevered arm element (20, 20', 25) extends with one side (21, 26) perpendicularly with respect to said slits (22, 27) and an opposite side inclined towards at least one free end of the cantilevered arm element (20, 20', 25) is such a way that the cantilevered arm element (20, 20', 25) tapers.

30. In a partitioning system in accordance with claim 1, wherein a plurality of support elements (56) are fixable between the connecting bar (15) of the post (10) and said shoulder (36) of one said screw socket (32) of said connecting element (30) fastened on the post (10), each said support element (56) has a semicircle receptacle (53) for said screw socket (32) in an area outside said shoulder (36) and is supported by a bar (52) on a facing said support bar (11 or 12) of the post (10), and at both sides of said bar (52) a receptacle for said panel (40) is formed, which is closed off at a bottom with a support plate (51).

31. In a partitioning system in accordance with claim 30, wherein said bar (52) of said support element (56) is fastened in a center of a thickness of said support element (56) and provides equal divisions, which are closed off at said bottom by support plates (51), and said thickness of said support elements (56) approximately corresponds to a width of the support bars (11, 12) protruding form the connecting bar (15) of the post (10) and approximately to a length of said screw sockets (31) in an area outside of said shoulder (36).

32. In a partitioning system in accordance with claim 1, wherein immediately adjacent said posts (10) of a two partition section are connectable with each other with a plurality of hinge elements (61) of a hinge (60) at arbitrary angles, where said hinge elements (61) terminate in plug shoulders which are insertable into said plug connections (35) of said screw sockets (31) of said connecting elements (30) which are fastened on the two posts (10) and are hingedly connected with each other.

33. In a partitioning system in accordance with claim 1, wherein the adjoining posts (10) are connectable with each other by a plurality of coupling elements which terminate on both ends in plug shoulders, which are insertable into the connecting elements (35) of screw connections (31) fixed on both posts (10) and fastened there, and two said plug shoulders of said coupling element are connected with each other with an elastic, deflectable intermediate piece.

34. In a partitioning system in accordance with claim 1, wherein a free side of the post (10) is covered with a cover section which is generally U-shaped in cross section.

35. In a partitioning system in accordance with claim 1, wherein on front ends facing the posts (10) the panels (40) have connecting shoulders (41) which are set back in relation to a visual side of the panel (40) by a thickness of the support bars (11, 12) of the posts (10).

36. In a partitioning system in accordance with claim 1, wherein a plurality of furniture pieces (50) are suspended by a plurality of angled profiled sections (51) from a top edge of partial panels (40), which protrude from a back of each said furniture piece (50) in the form of hangers (52).

37. In a partitioning system in accordance with claim 1, wherein said bores (16) of the posts (10) are polygonal in cross section.

38. In a partitioning system in accordance with claim 1, wherein said threaded coupling (31) forms one piece with one of said two screw sockets (32).

39. In a partitioning system in accordance with claim 1, wherein said arm bore (23, 28) of one of the cantilevered arm elements (20, 20', 25) has a widened section facing said shoulder (36) of said screw socket (32), which receives at least a part of said shoulder (36) of said screw socket (32).

* * * * *